US010787886B2

(12) United States Patent
Huang et al.

(10) Patent No.: US 10,787,886 B2
(45) Date of Patent: Sep. 29, 2020

(54) AUXILIARY FEEDING DEVICE FOR FLEXIBLE PIPE OF RADIAL HORIZONTAL WELL

(71) Applicant: China University of Petroleum—Beijing, Beijing (CN)

(72) Inventors: Zhongwei Huang, Beijing (CN); Jingbin Li, Beijing (CN); Jilei Niu, Beijing (CN); Gensheng Li, Beijing (CN); Zhen Cheng, Beijing (CN)

(73) Assignee: China University of Petroleum—Beijing, Beijing (CN)

( * ) Notice: Subject to any disclaimer, the term of this patent is extended or adjusted under 35 U.S.C. 154(b) by 67 days.

(21) Appl. No.: 16/307,936

(22) PCT Filed: May 12, 2017

(86) PCT No.: PCT/CN2017/084070
§ 371 (c)(1),
(2) Date: Dec. 6, 2018

(87) PCT Pub. No.: WO2018/120581
PCT Pub. Date: Jul. 5, 2018

(65) Prior Publication Data

US 2019/0264544 A1 Aug. 29, 2019

(30) Foreign Application Priority Data

Dec. 27, 2016 (CN) ..... 2016 1 1225315

(51) Int. Cl.
*E21B 41/00* (2006.01)
*E21B 7/04* (2006.01)
(Continued)

(52) U.S. Cl.
CPC ..... *E21B 41/0035* (2013.01); *E21B 7/046* (2013.01); *E21B 7/061* (2013.01);
(Continued)

(58) Field of Classification Search
CPC ..... E21B 41/0035; E21B 7/061; E21B 7/046; E21B 7/18; E21B 41/00; E21B 7/06; E21B 44/00; E21B 7/04
See application file for complete search history.

(56) References Cited

U.S. PATENT DOCUMENTS 4,693,327 A 9/1987 Dickinson et al.
9,890,592 B2 * 2/2018 Marshall ..... E21B 7/04
(Continued)

FOREIGN PATENT DOCUMENTS

CN 1149663 11/1995
CN 2388337 3/1999
(Continued)

OTHER PUBLICATIONS

Chinese Search Report for Chinese Application No. 201611225315.1, dated May 8, 2018, 4 pages.
(Continued)

*Primary Examiner* — D. Andrews
*Assistant Examiner* — Manuel C Portocarrero
(74) *Attorney, Agent, or Firm* — Loza & Loza, LLP; Michael F. Fedrick

(57) ABSTRACT

An auxiliary feeding device for a flexible pipe of a radial horizontal well, comprising an oil pipe, a steering gear connected to the oil pipe at a lower opening, and two impellers. Each of the impellers comprises an impeller shaft, a barrel body and at least three blades fixed outside the barrel body and provided at a top thereof with a notch, where the two impeller shafts are parallel to each other. The two impellers are parallel and are synchronously rotated, and the notches on two sides of the inlet are in one-to-one correspondence relation to form a holding passage that can clamp the flexible pipe.

12 Claims, 11 Drawing Sheets

(51) Int. Cl.
*E21B 7/06* (2006.01)
*E21B 7/18* (2006.01)

(52) U.S. Cl.
CPC . *E21B 7/06* (2013.01); *E21B 7/18* (2013.01); *E21B 41/00* (2013.01)

(56) References Cited

U.S. PATENT DOCUMENTS

| | | | |
|---|---|---|---|
| 2007/0151766 | A1 | 7/2007 | Butler et al. |
| 2013/0327573 | A1 | 12/2013 | Belew et al. |

FOREIGN PATENT DOCUMENTS

| | | |
|---|---|---|
| CN | 2615322 | 2/2003 |
| CN | 101660391 | 8/2008 |
| CN | 102704840 | 5/2012 |
| CN | 104343424 | 8/2013 |
| CN | 105134072 | 8/2015 |
| CN | 105089500 | 9/2015 |
| CN | 105201436 | 10/2015 |
| WO | 2001061141 | 2/2000 |

OTHER PUBLICATIONS

Chinese Office Action for Chinese Application No. 201611225315.1, dated May 17, 2018, 7 pages.
International Search Report for International Application No. PCT/CN2017/084070, dated Sep. 15, 2017, 2 pages.

* cited by examiner

AUXILIARY FEEDING DEVICE FOR FLEXIBLE PIPE OF RADIAL HORIZONTAL WELL

CROSS-REFERENCE TO RELATED APPLICATIONS

This application is the U.S. national stage of International Patent Application No. PCT/CN2017/084070, filed on May 12, 2017, which claims the benefit of priority under 35 U.S.C. § 119 from Chinese Patent Application No. 201611225315.1, entitled "AUXILIARY FEEDING DEVICE FOR FLEXIBLE PIPE OF HORIZONTAL WELL IN RADIAL DIRECTION" and filed on Dec. 27, 2016. The content of the foregoing applications is incorporated herein by reference in its entirety.

TECHNICAL FIELD

The present invention relates to the technical field of oil exploitation, and in particular to an auxiliary feeding device for a flexible pipe of a radial horizontal well.

BACKGROUND ART

As the developments of the oil and gas fields in central and eastern China have entered the middle and late stages, the number of the old and abandoned wells increasingly rises, and it is urgent to promote the renovation of the old wells and tap the potential of the remaining oil. The developments of the old oil fields also face the problems of high water injection pressure and low edge well recovery ratio. Meanwhile, the new proved reserves are still insufficient, while most of the unutilized reserves are complex oil and gas reservoirs such as those with low permeability, thickened oil and oil sheets, as well as the fractured oil and gas reservoirs.

The ultra-short radius sidetrack horizontal well drilling technology (also known as the radial horizontal well drilling technology) is a new oilfield production increasing technology developed in recent decades, which means radially drilling one or more horizontal wellbores which are radially distributed in a vertical wellbore. The radial horizontal well drilling technology achieves a steering of tens of meters of high-pressure flexible pipe from a vertical direction to a horizontal direction in a casing by a steering gear within a small turning radius, realizes a continuous rock breaking drilling through a rotary jetting by a water jet bit, and finally forms micro wellbores.

The radial horizontal well drilling technology can be utilized to restore the dead wells, thereby greatly improving the oil well production and the oil recovery ratio, and reducing the drilling cost. Therefore, the radial horizontal well drilling technology is an effective measure to renovate the old oil fields, tap the potential of the reservoirs, and stabilize and increase the production, especially suitable for the developments of those with oil sheets, vertical fractures, thickened oil and low permeability, the water-injected "dead oil area", and the lithological trapped reservoirs. The radial horizontal drilling technology has gradually shown many advantages in exploitations of the complex oil and gas reservoirs, gradually become an effective measure for tapping the potential of the old oilfields and stabilizing the production of the old oilfields, and also become a development direction for increasing the coal bed gas production per well.

In addition to protecting the oil and gas formations, the radial horizontal well drilling technology can deplug the well drilling, well cementation and fractured immediate vicinity of wellbore, communicate the micro-crack and fracture system, reduce the fluid flow resistance, and improve the oil and gas production. Further, the radial horizontal well drilling technology can effectively prevent the gas cone or water cone effect.

The radial horizontal well drilling technology needs to achieve a steering from the vertical direction to the horizontal direction within a turning radius of 300 mm. After the development in recent decades, the technology has evolved from the initial radial horizontal well technology that performs large diameter reaming to form an ultra-short radius, to the current radial horizontal well technology that steers within the casing. The steering gear within the casing has a small turning radius, an accurate orientation, a simple structure and a small volume, and there is no need for forging and milling the casing or reaming.

However, the radial horizontal well technology that steers within the casing can only take the high-pressure flexible pipe as the working line which is difficult to be continuously fed downward. In addition, the high-pressure flexible pipe has a complicated downhole stress state, and the track of the steering gear is narrow; during the downhole drilling, the high-pressure flexible pipe is easy to produce very large bending and buckling deformations when passing through the steering gear within the small turning radius, and a resistance from the narrow track is increased correspondingly, which may result in discontinuous feeding.

In the prior art, the continuous drilling of the high-pressure flexible pipe is achieved by the self-feeding force generated by the self-feeding porous jet nozzle provided at an end of the high-pressure flexible pipe. In the downhole, the self-feeding jet nozzle should not only generate a self-feeding force for the forward traction of the drilling string, but also meet the requirement of the high-efficiency rock breaking. The on-way pressure loss of the drilling fluid is inversely proportional to the inner diameter of the high-pressure flexible pipe and proportional to its length. Due to the limitation of the steering size, the inner diameter and the outer diameter of the high-pressure flexible pipe are small; and usually tens of meters of high-pressure flexible pipe is required for the radial horizontal well drilling, so that limited hydraulic energy can be transmitted to the downhole, and the hydraulic energy for the high-pressure flexible pipe to perform the string traction and rock breaking is insufficient, which finally restricts the horizontal drilling distance and thus limits the overall development of the radial horizontal well technology.

SUMMARY OF THE INVENTION

In order to solve the technical problem that the flexible pipe cannot be continuously and efficiently fed in a radial horizontal well, the present invention proposes an auxiliary feeding device for a flexible pipe of a radial horizontal well, which can effectively overcome the frictional resistance and feed the flexible pipe stably, while effectively adjusting the feeding speed of the flexible pipe so that the flexible pipe can be continuously fed and the rock can be broken efficiently, and finally achieve the objective of improving the exploitation efficiency of oil and gas resources.

The present invention proposes an auxiliary feeding device for a flexible pipe of a radial horizontal well, comprising an oil pipe, a steering gear connected to the oil pipe at a lower opening thereof, and two impellers;

an upper end surface of the steering gear is provided with an accommodating groove; the steering gear is internally provided with a through steering passage in an axial direction thereof for allowing an external flexible pipe to pass through; an inlet of the steering passage is located at a bottom wall of the accommodating groove, and an outlet of the steering passage is located at a lower portion of a sidewall of the steering gear;

the two impellers are located at a bottom of the accommodating groove and symmetrically disposed on two sides of the inlet; each of the impellers comprises an impeller shaft fixed in the accommodating groove, a barrel body rotatably surrounding the impeller shaft, and at least three blades fixed outside the barrel body, wherein the two impeller shafts are parallel to each other, and each of the blades is provided at a top thereof with a notch;

during relative and synchronous rotation of the two impellers, the notches of the two impellers are in one-to-one correspondence relation at the inlet to form a holding passage that can clamp the flexible pipe; a lower end of the flexible pipe enters the steering passage through an inner cavity of the oil pipe, the holding passage, and the inlet from top to bottom in sequence, and protrudes from the outlet; fluid injected through an upper opening of the oil pipe drives the impellers to rotate downward in an axial direction of the flexible pipe, and causes the flexible pipe clamped in the holding passage to be fed downward.

As compared with the prior art, the present invention has the following advantageous effects: the auxiliary feeding device for the flexible pipe of the radial horizontal well according to the present invention can provide feeding power to overcome the frictional resistance when the flexible pipe in the ultra-short radius radial horizontal well passes through the steering gear to drill; meanwhile, the feeding speed of the flexible pipe can be effectively adjusted by adjusting the velocity of the fluid, so that the flexible pipe can be continuously and stably fed and the rock can be broken efficiently, which shortens the drilling cycle and improves the drilling efficiency, and finally achieves the objective of improving the exploitation efficiency of oil and gas resources.

In the present invention, the fluid can be injected into the oil pipe to drive the impellers to rotate, so that the static frictional force between the holding passage and the flexible pipe provides the feeding power to the flexible pipe and overcomes the frictional force, thus feeding the high-pressure flexible pipe. The porous jet nozzle is connected at a lower end of the flexible pipe, and after the fluid is injected into the flexible pipe, the porous jet nozzle generates a self-feeding force which pulls the flexible pipe forward, and which can also auxiliarily pull the flexible pipe downward.

When the fluid is pumped from the upper opening of the oil pipe and flows through the slope, the slope causes the flow-through gap to be wide at the top and narrow at the bottom while guiding the fluid to impact the impellers; thus, the flow-through area of the drilling fluid is reduced, and the drilling fluid is rapidly pressurized in a short period of time to impact the impellers to rotate quickly and sensitively. A large impact force is obtained by adjusting the angle for the fluid to impact the impellers, and finally large feeding power is generated for the flexible pipe. A distance between lower ends of the two slopes is smaller than a distance between the two impeller shafts, which effectively blocks or limits the fluid from impacting the blades far away from the flexible pipe, thereby avoiding the disorder of the rotation direction of the impellers.

When the impellers rotate, the notches close to the flexible pipe (at the middle) form a holding passage for clamping the flexible pipe, and other notches located above the impeller shafts are tightly matched with the limiting blocks, which limits the fluid from flowing away from the other notches in a direction opposite to a rotation direction of the impellers, and blocks the fluid, thereby avoiding the loss of hydraulic energy.

DETAILED DESCRIPTION OF THE PREFERRED EMBODIMENTS

Figure 1:
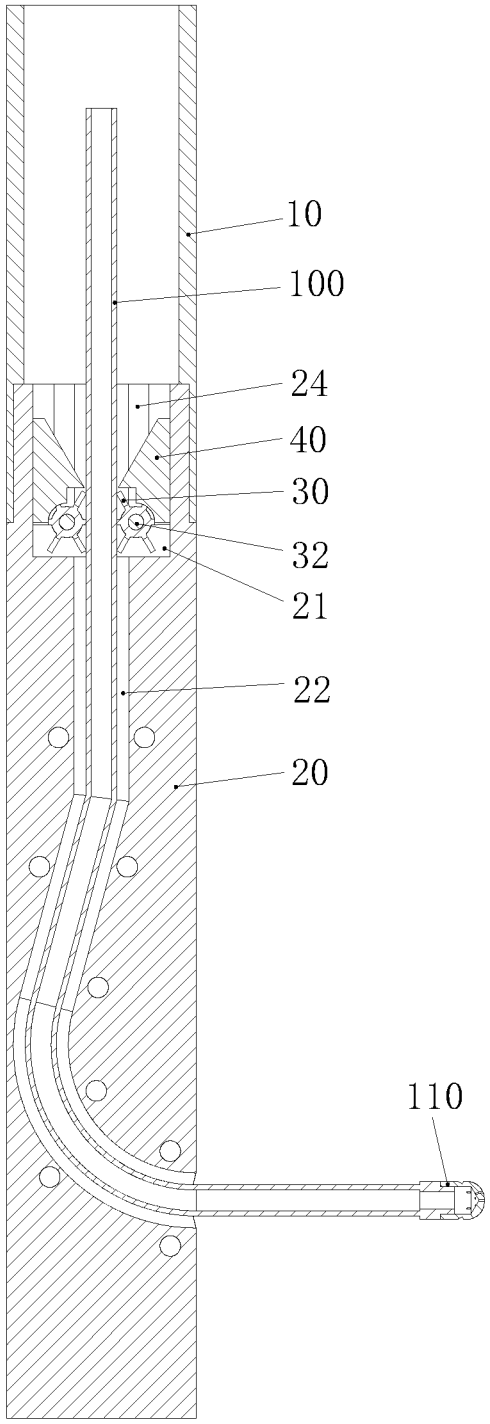
FIG. 1 is a front sectional schematic view of an auxiliary feeding device for a flexible pipe of a radial horizontal well according to the present invention.

The above technical features and advantages of the present invention are clearly and completely described as follows in conjunction with the drawings. It is obvious that those described are only some, rather than all, of the embodiments of the present invention.

Referring to FIGS. 1 to 4, the present invention proposes an auxiliary feeding device for a flexible pipe of a radial horizontal well, comprising an oil pipe 10, a steering gear 20 connected to the oil pipe 10 at a lower opening thereof, and two impellers 30.

Referring to FIGS. 1 and 5 to 7, an upper end surface of the steering gear 20 is provided with an accommodating groove 21; the steering gear 20 is internally provided with a through steering passage 22 in an axial direction thereof for allowing an external flexible pipe 100 to pass through; an inlet of the steering passage 22 is located at a bottom wall of the accommodating groove 21, and an outlet of the steering passage 22 is located at a lower portion of a sidewall of the steering gear 20.

Figure 5:
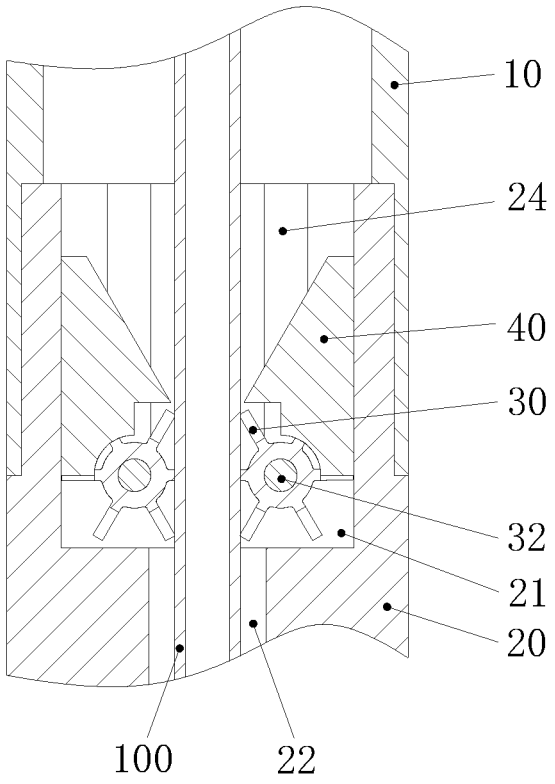
FIG. 5 is a partial schematic view of an auxiliary feeding device for a flexible pipe of a radial horizontal well according to the present invention at an accommodating groove.
Figure 8:
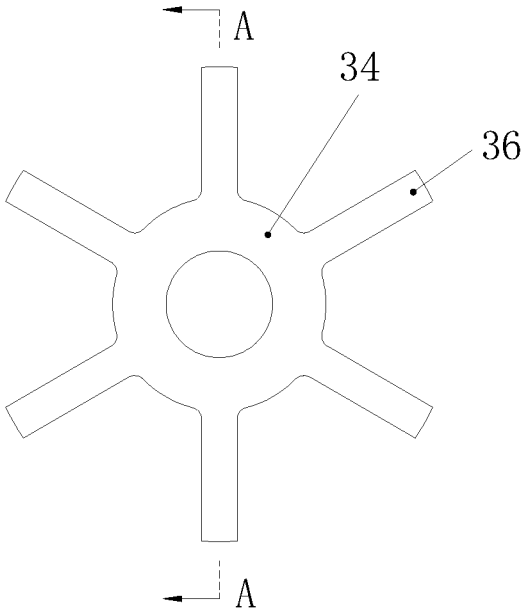
FIG. 8 is a front schematic view of an impeller of an auxiliary feeding device for a flexible pipe of a radial horizontal well according to the present invention.
Figure 9:
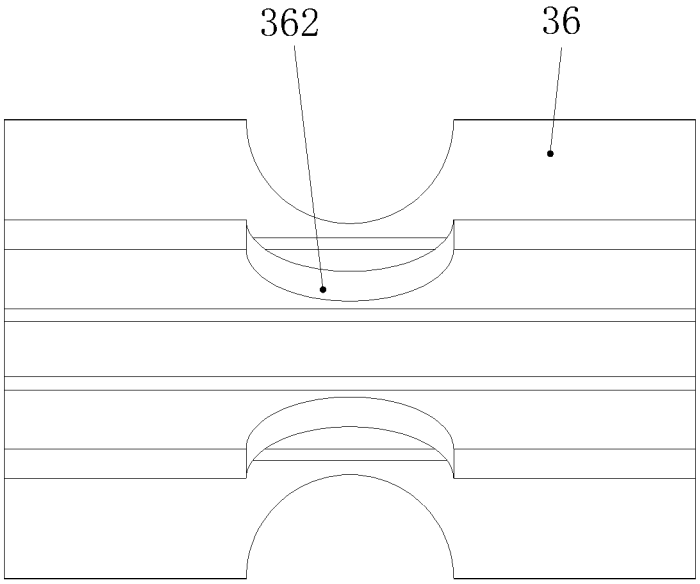
FIG. 9 is a left schematic view of an impeller of an auxiliary feeding device for a flexible pipe of a radial horizontal well according to the present invention.
Figure 10:
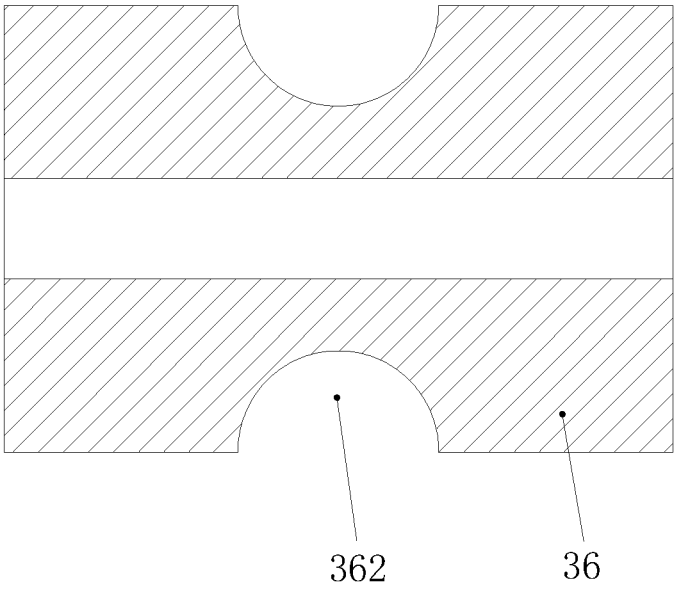
FIG. 10 is an A-A sectional schematic view of FIG. 8.
Figure 11:
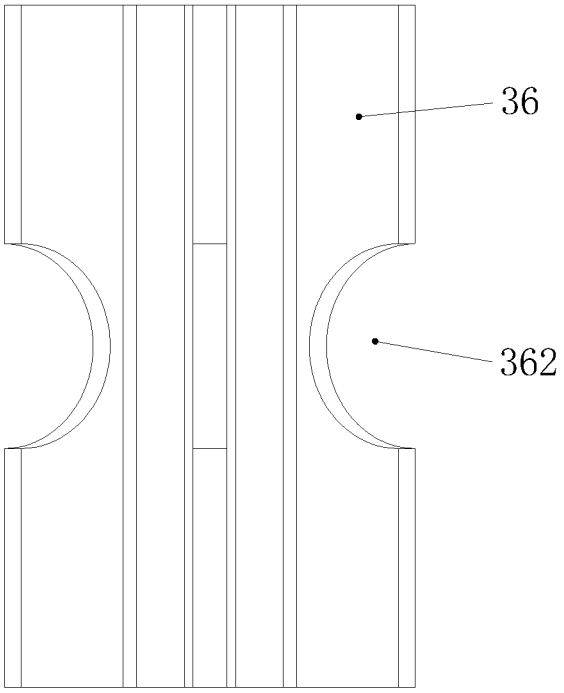
FIG. 11 is a top schematic view of an impeller of an auxiliary feeding device for a flexible pipe of a radial horizontal well according to the present invention.

As shown in FIG. 5, the two impellers 30 are located at a bottom of the accommodating groove 21 and symmetrically disposed on two sides of the inlet. Referring to FIGS. 5 and 8, each of the impellers 30 comprises an impeller shaft 32 fixed in the accommodating groove 21, a barrel body 34 rotatably surrounding the impeller shaft 32, and at least three blades 36 each fixed outside the barrel body 34, and the two impeller shafts 32 are parallel to each other. Referring to FIGS. 9 to 11, each of the blades 36 is provided at a top (i.e., an outer edge) thereof with a notch 362.

As shown in FIG. 1, during relative and synchronous rotation of the two impellers 30, the notches 362 of the two impellers 30 are located in one-to-one correspondence relation at the inlet (i.e., the notches 362 on the two sides of the inlet are in one-to-one correspondence relation) to form a holding passage that can clamp the flexible pipe 100. A lower end of the flexible pipe 100 enters the steering passage 22 through an inner cavity of the oil pipe 10, the holding passage and the inlet from top to bottom in sequence, and protrudes from the outlet. The fluid injected through an upper opening of the oil pipe 10 drives the impellers 30 to rotate downward in an axial direction of the flexible pipe 100, and causes the flexible pipe 100 clamped in the holding passage to be fed downward.

As shown in FIG. 5, after being driven by the fluid, the impeller 30 on the left side continues to rotate in a clockwise direction, and the impeller 30 on the right side continues to rotate in a counterclockwise direction, while the notches 362 close to the flexible pipe 100 on the left and right sides form the holding passage and clamp the flexible pipe 100 from the left and right sides respectively. During the rotation of the impellers 30, the clamped flexible pipe 100 is caused to be fed downward by a frictional resistance.

Preferably, the two impellers 30 have the same size, i.e., the impeller shafts 32 have the same diameter and length, the barrel bodies 34 have the same diameter and length, and the blades 36 have the same width and length. When the fluid is injected through the upper opening of the oil pipe 10, the two impellers 30 are subjected to the same impact force from the fluid since their structures and sizes are the same, which ensures that the two impellers 30 can rotate synchronously.

Preferably, since the velocity of the fluid injected through the upper opening of the oil pipe 10 is relatively high and the sizes of the two impellers 30 are relatively small, the impellers 30 rotate fast after being impacted by the fluid; the fluid is usually continuously injected, which ensures that the two impellers 30 can rotate synchronously at a high speed, so that the notches 362 on the left and right sides of the flexible pipe can be in one-to-one correspondence relation, and cooperate from the left and right sides to form the holding passage.

The auxiliary feeding device for the flexible pipe of the radial horizontal well according to the present invention can provide feeding power to overcome the frictional resistance when the flexible pipe in the ultra-short radius radial horizontal well passes through the steering gear 20. The present invention solves the defect that it is difficult to effectively overcome the frictional resistance and feed the high-pressure flexible pipe during the construction using the ultra-short radius radial horizontal well technology. Through the present invention, the flexible pipe 100 can be mechanically fed in the radial horizontal well, and the frictional resistance is effectively overcome, so that the flexible pipe 100 can be stably fed; meanwhile, the feeding speed of the flexible pipe 100 can be effectively adjusted by adjusting the velocity of the fluid, so that the flexible pipe 100 can be continuously and stably fed and the rock can be broken efficiently, thus finally achieving the objective of improving the exploitation efficiency of oil and gas resources.

In this embodiment, the fluid is a drilling fluid, and the flexible pipe 100 is a high-pressure flexible pipe capable of withstanding a high pressure. The pressure of the fluid injected through the upper opening of the oil pipe 10 is insufficient to deform the flexible pipe 100 from the outside, and during operation, the flexible pipe 100 is full of high-pressure fluid that usually has a pressure of greater than or equal to 25 MPa and less than or equal to 50 MPa. Thus, the flexible pipe 100 also applies a force to the outside and will not be extruded and deformed.

In the auxiliary feeding device for the flexible pipe of the radial horizontal well according to the present invention, the fluid may be injected into the oil pipe 10 to drive the impellers 30 to rotate, so that a static frictional force between the holding passage and the flexible pipe 100 can provide the feeding power for the flexible pipe 100 and overcome the frictional force, thus feeding the high-pressure flexible pipe. Preferably, a porous jet nozzle 110 is connected at a lower end (i.e., a tail end) of the flexible pipe 100; after fluid is injected into the flexible pipe 100, the porous jet nozzle 110 generates a self-feeding force which pulls the flexible pipe 100 forward, and which can also auxiliarily pull the flexible pipe 100 downward.

Preferably, the inner diameter of the steering passage 22 is greater than the outer diameter of the flexible pipe 100. In order to prevent the buckling deformation of the high-pressure flexible pipe in the steering passage 22, the size of the steering passage 22 should not be too large. The drilling fluid flows through an annular space between the steering passage 22 and the flexible pipe 100 to lubricate the flexible pipe 100, and reduce the frictional resistance to the downward feeding of the flexible pipe 100. The auxiliary feeding device for the flexible pipe of the radial horizontal well according to the present invention has a simple and reliable structure and simple operations, and can be easily controlled.

The present invention mechanically enables the flexible pipe 100 to overcome the resistance upon passing through the steering gear 20, and provides stable power for feeding the flexible pipe 100 downward, thereby ensuring continuous and efficient drilling, shortening the drilling cycle, and improving the drilling efficiency. When the displacement of the ground drilling fluid is increased or decreased, the rotation speed of the impeller 30 about the impeller shaft 32 is increased or decreased accordingly. Due to the clamping effect of the holding passage on the flexible pipe 100, the feeding speed of the flexible pipe 100 is correspondingly increased or decreased under the effect of the static frictional force. In addition, the rock breaking capacity of the porous jet nozzle 110 connected to the lower end of the flexible pipe 100 also varies with the displacement of the drilling fluid, thereby achieving the consistency between the feeding speed of the flexible pipe 100 and the rock breaking speed of the porous jet nozzle 110.

Figure 4:
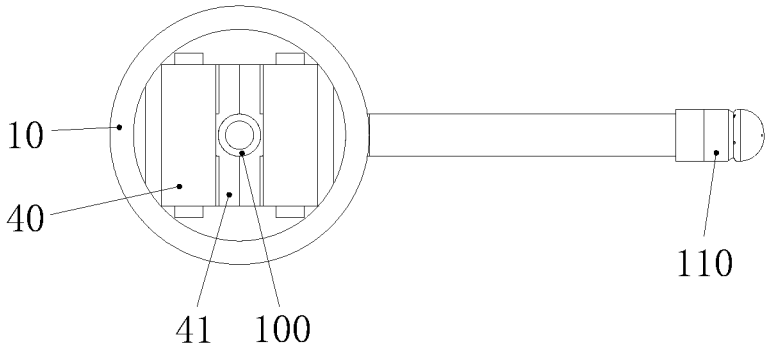
FIG. 4 is a top schematic view of an auxiliary feeding device for a flexible pipe of a radial horizontal well according to the present invention.

Further, as shown in FIGS. 4 and 5, the auxiliary feeding device for the flexible pipe of the radial horizontal well further comprises two flow guiding and limiting bodies 40 which are symmetrically disposed on two sides of the inlet to form a flow-through gap 41 therebetween.

Each of the flow guiding and limiting bodies 40 is fixed in the accommodating groove 21, and disposed above the corresponding impeller 30. The fluid injected through the upper opening of the oil pipe 10 passes through the flow-through gap 41, applies a force to the two blades 36 forming the holding passage, and drives the impellers 30 to rotate downward in the axial direction of the flexible pipe 100.

The fluid is guided by the flow guiding and limiting bodies 40 to impact the impellers 30 to rotate; while the impellers 30 are rotating, the static frictional force generated between the holding passage and the flexible pipe 100 serves as the power to overcome the frictional resistance to the flexible pipe 100 in the steering gear 20, thereby gradually feeding the flexible pipe 100 downward.

Figure 12:
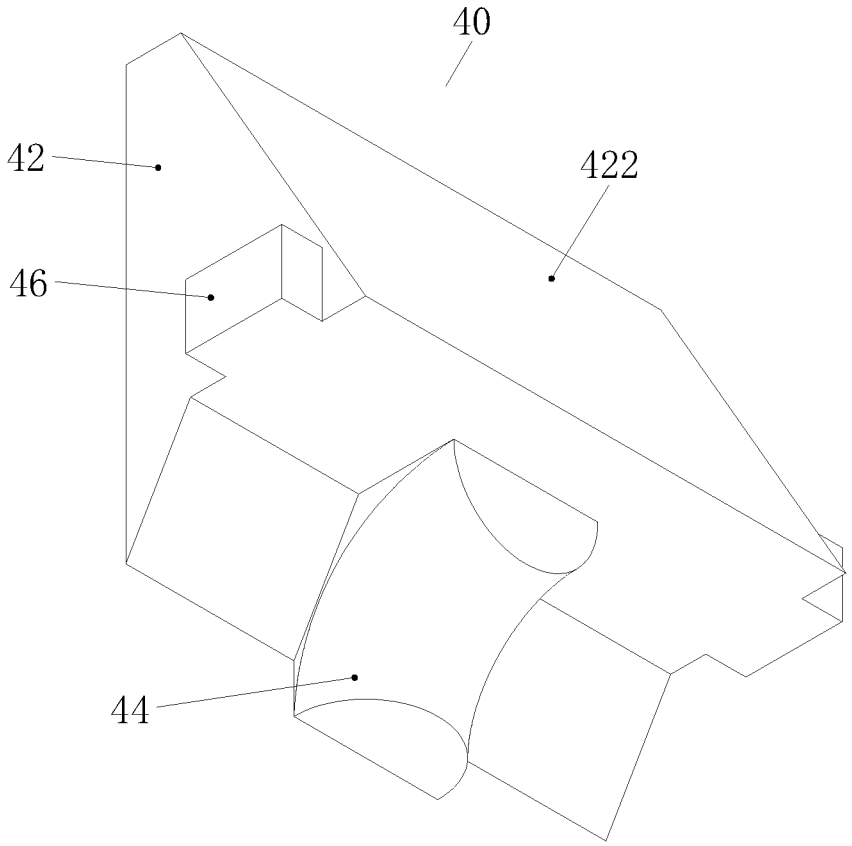
FIG. 12 is a stereo schematic view of a flow guiding and limiting body of an auxiliary feeding device for a flexible pipe of a radial horizontal well according to the present invention.
Figure 13:
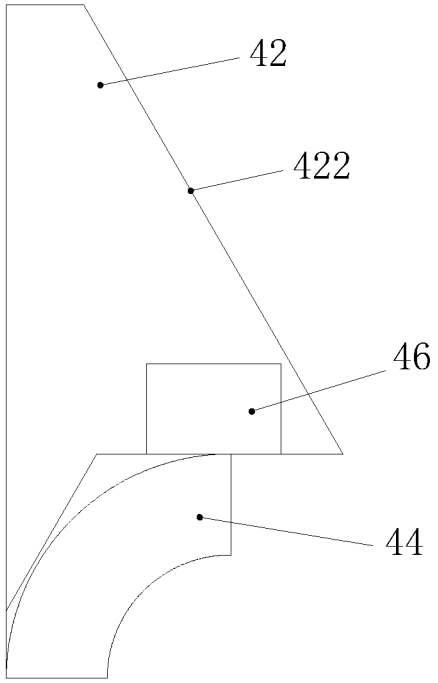
FIG. 13 is a front schematic view of a flow guiding and limiting body of an auxiliary feeding device for a flexible pipe of a radial horizontal well according to the present invention.
Figure 14:
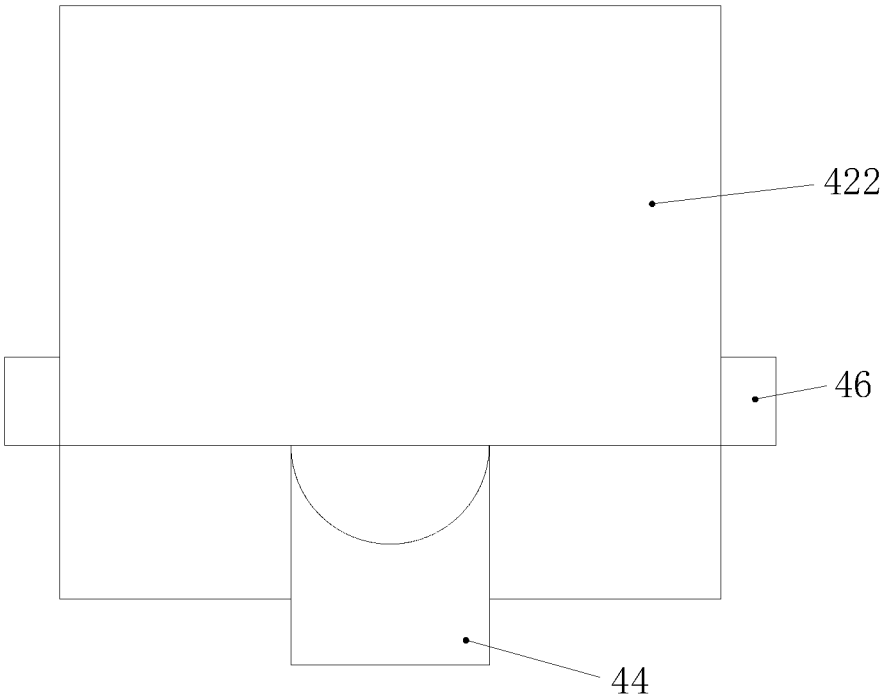
FIG. 14 is a right schematic view of a flow guiding and limiting body of an auxiliary feeding device for a flexible pipe of a radial horizontal well according to the present invention.

Further, referring to FIGS. 12 to 14, each of the flow guiding and limiting bodies 40 at least comprises a flow guiding body 42, one side of which abuts against a sidewall of the accommodating groove 21, and an opposite side of which is provided with a slope 422. As shown in FIG. 5, the flow-through gap 41 is located between two slopes 422 and has a truncated cone shape that is reduced from top to bottom.

After the pumping is started on the ground, the fluid (e.g., the drilling fluid) is pumped in from the upper opening of the oil pipe 10. When the fluid flows through the slope 422, since the slope 422 is at an angle with the vertical direction, the slope 422 causes the flow-through gap 41 to be wide at the top and narrow at the bottom while guiding the fluid to impact the impellers 30; thus, the flow-through area of the drilling fluid is reduced, and the drilling fluid is rapidly pressurized in a short period of time to impact the impeller 30 to rotate quickly and sensitively.

Preferably, the angle between the slope 422 and the vertical direction can be adjusted based on actual needs, so as to adjust the angle for the fluid to impact the impeller 30 to obtain a large impact force, thereby increasing the rotation speed of the impeller 30, and finally generating the large feeding power for the flexible pipe 100.

Further, each of the flow guiding and limiting bodies 40 further comprises a limiting block 44 that is fixed to a bottom of the fluid guiding body 42. Each of the limiting blocks 44 is extended in a rotation direction of the corresponding blade 36, and a cross-sectional shape of the limiting block 44 is matched with a shape of the notch 362.

In order to prevent the fluid from flowing away in a direction opposite to a rotation direction of the impellers 30 after the fluid passes through the flow-through gap 41, the limiting block 44 matching the notch 362 in shape and size is designed by simulating the rotation trajectory of the notch 362. As shown in FIG. 5, when the impellers 30 rotate, the notches 362 close to the flexible pipe 100 (at the middle) form the holding passage for clamping the flexible pipe 100, and other notches 362 located above the impeller shafts 32 are tightly matched with the limiting blocks 44. That is, the limiting blocks 44 are tightly fitted into other notches 362 located above the impeller shafts 32, so as to limit the fluid from flowing away from the other notches 362 in the direction opposite to the rotation direction of the impellers 30, and block the fluid, thereby avoiding the loss of hydraulic energy.

Further, as shown in FIG. 5, a distance between lower ends of the two slopes 422 is smaller than a distance between the two impeller shafts 32.

As shown in FIG. 5, taking the impeller 30 at the left side as an example, when the fluid impacts the blade 36 at the right side of the impeller shaft 32, a part of the fluid causes the impeller 36 to rotate clockwise, thereby forming a mechanical driving force to drive the flexible pipe 100 to be fed. Due to the existence of the slopes 422, particularly since the distance between lower ends of the two slopes 422 is smaller than the distance between the two impeller shafts 32, the fluid is effectively blocked or limited from impacting the blade 36 at the left side of the impeller shaft 32 (far away from the flexible pipe 100), thereby avoiding the disorder of the rotation direction of the impellers 30.

However, each of the blades 36 has a notch 362, and when the fluid impacts the blade 36 at the right side of the impeller shaft 32, a part of the fluid may flow away from the notch 362 of the impeller 30 at the left side of the impeller shaft 32, which causes the loss of hydraulic energy. In order to avoid the loss of hydraulic energy, the part of the fluid should be limited from flowing away (counterclockwise) from the above of the impeller 30. Thus, the flow guiding and limiting body 40 is designed with the limiting block 44.

The design process of the limiting block 44 is as follows: the notch 362 rotates by a certain angle to form a curved surface, and a space enclosed by the curved surface and the bottom of the fluid guiding body 42 is the shape of the limiting block 44. The rotation angle of the notch 362 is not limited, as long as the formed shape of the limiting block 44 is sufficient to limit the fluid from flowing away from the notch 362 of the blade 36 at the left side of the impeller shaft 32.

In this embodiment, the rotation angle of the notch 362 is 90 degrees. Since the curved surface of the limiting block 44 is obtained by the rotation of the notch 362, it can be tightly matched with the notch 362. The notch 362 rotated to the limiting block 44 is tightly fitted with the curved surface of the limiting block 44, so as to effectively limit the fluid from flowing away in the direction opposite to the rotation direction of the impeller 30.

Taking the slope 422 of the flow guiding and limiting body 40 at the left side as an example, under the condition that the height of the slope 422 is constant, the angle between the slope 422 and the vertical direction is acute. The angle should ensure that the fluid does not directly impact the blade 36 located at the left side of the impeller shaft 32 of the impeller 30 corresponding to a lower portion of the slope so as to cause the disordered rotation of the impeller. Thus, the fluid directly impacts the blade 36 located at the right side of the impeller shaft 32 of the impeller 30 corresponding to the lower portion of the slope so as to form a driving force that drives the flexible pipe 100 to be fed downward. Preferably, the angle between the slope 422 and the vertical direction is 30 degrees to 45 degrees.

Figure 6:
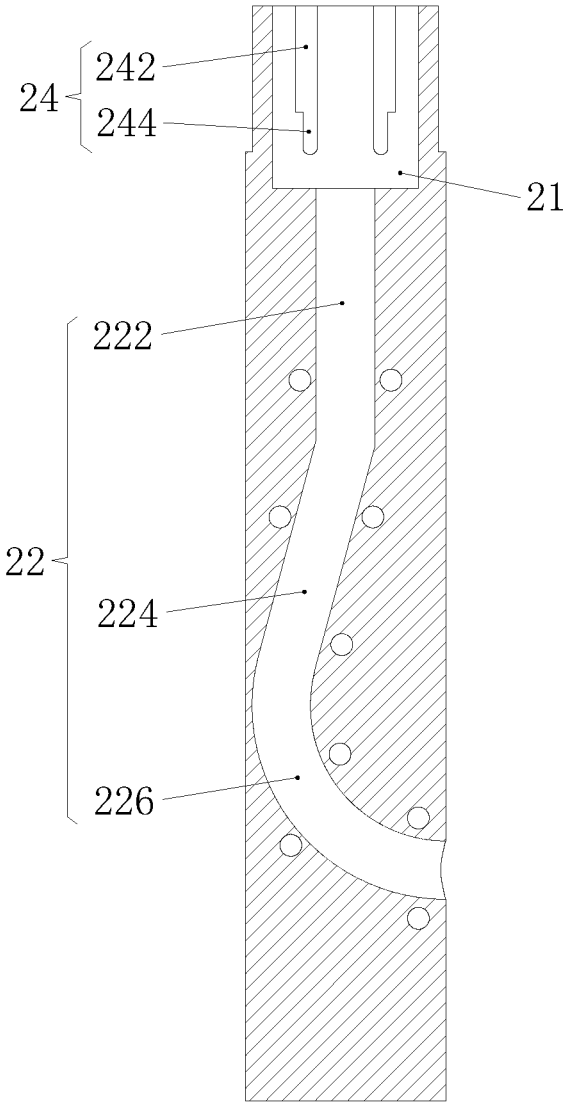
FIG. 6 is a sectional schematic view of a first steering body of an auxiliary feeding device for a flexible pipe of a radial horizontal well according to the present invention.

Further, each of the flow guiding and limiting bodies 40 further comprises at least one fixing block 46 that is fixed to the sidewall of the flow guiding body 42. As shown in FIG. 6, the accommodating groove 21 is provided on the sidewall thereof with assembly chutes 24 which are slidably matched with the fixing blocks 46 respectively, and the fixing blocks 46 can be fixed in the assembly chutes 24.

As shown in FIG. 13, the flow guiding body 42 is a trapezoidal column having a trapezoidal longitudinal section, wherein a straight sidewall at the left side abuts against the sidewall of the accommodating groove 21, and an opposite inclined sidewall at the right side is the slope 422. In this embodiment, the fixing blocks 46 are respectively disposed on the straight sidewalls at the front side and the rear side of the flow guiding body 42; correspondingly, four assembly chutes 24 are provided on the sidewall of the accommodating groove 21.

Further, each of the impeller shafts 32 is horizontally disposed, and two ends of each of the impeller shafts 32 are fixed in the assembly chute 24, respectively.

After the impeller shaft 32 is inserted into the center hole of the barrel body 34 to complete the assembly, the impeller 30 is placed in the accommodating groove 21, and both ends of the impeller shaft 32 are slid into the assembly chute 24 to limit the position of the impeller 30. Next, the two fixing blocks 46 of the flow guiding and limiting body 40 are slid into the assembly chute 24, so that the flow guiding and limiting body 40 is fixed in the accommodating groove 21. Preferably, the fixing block 46 is in an interference fit with the assembly chute 24 to form a reliable connection.

Further, as shown in FIG. 6, the assembly chute 24 comprises a slide-in section 242 and a clamping section 244 which are sequentially disposed from top to bottom. The width of the clamping section 244 (i.e., the dimension in the horizontal direction) is smaller than the width of the slide-in section 242 (i.e., the dimension in the horizontal direction). The two ends of each of the impeller shafts 32 are fixed in corresponding clamping sections 244, respectively.

That is, the assembly chute 24 is wide at the top and narrow at the bottom. After being inserted into the assembly chute 24 from a wider portion at the upper end (i.e., the slide-in section 242) and sliding along the assembly chute 24, each of the impeller shafts 32 goes to the narrower portion at the lower end (i.e., the clamping section 244), and is fixed and clamped by gravity. In this embodiment, the width of the fixing block 46 is larger than the diameter of the impeller shaft 32, so that the fixing block 46 is clamped in the slide-in section 242.

Further, as shown in FIGS. 8 and 9, the blades 36 are tabulate, extended in an axial direction of the corresponding impeller shaft 32, and evenly arranged in a circumferential direction of the corresponding impeller shaft 32.

Preferably, the number of the blades 36 of each of the impellers 30 can be adjusted based on actual needs, so that the maximum feeding power can be obtained when the injected drilling fluid impacts the blade 36. In this embodiment, the number of the blades 36 of each of the impellers 30 is six.

Preferably, the number of the blades 36 of each of the impellers 30 is at least six, that is, the blades 36 are set densely; during relative rotations of the two impellers 30, the frequency at which the blades 36 contact the flexible pipe 100 is increased, so that the notches 362 at the left and right sides of the inlet can be in one-to-one correspondence relation accurately, thereby reliably forming the holding passage.

Further, as shown in FIG. 10, the notch 362 is semicircular, and accordingly, the formed holding passage is circular, wherein an inner diameter of the holding passage is smaller than an outer diameter of the flexible pipe 100. Preferably, the inner diameter of the holding passage is 1 mm to 2 mm smaller than the outer diameter of the flexible pipe 100, so that the flexible pipe 100 can be effectively clamped.

According to the outer diameter of the flexible pipe 100, the barrel body 34 and the notches 362 are sized to ensure that the notches 362 can hold the flexible pipe 100 during operation. As a result, during rotation of the impeller 30, a sufficient static frictional force can be generated between the impeller 30 and the flexible pipe 100, and finally the flexible pipe 100 is stably and continuously fed.

Figure 2:
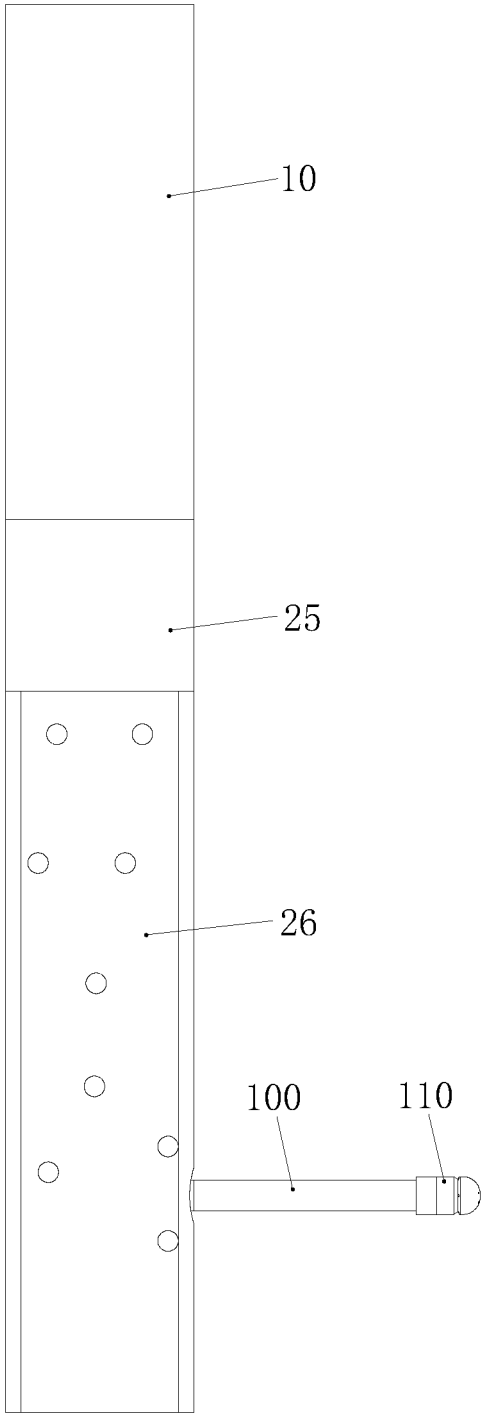
FIG. 2 is a front schematic view of an auxiliary feeding device for a flexible pipe of a radial horizontal well according to the present invention.
Figure 3:
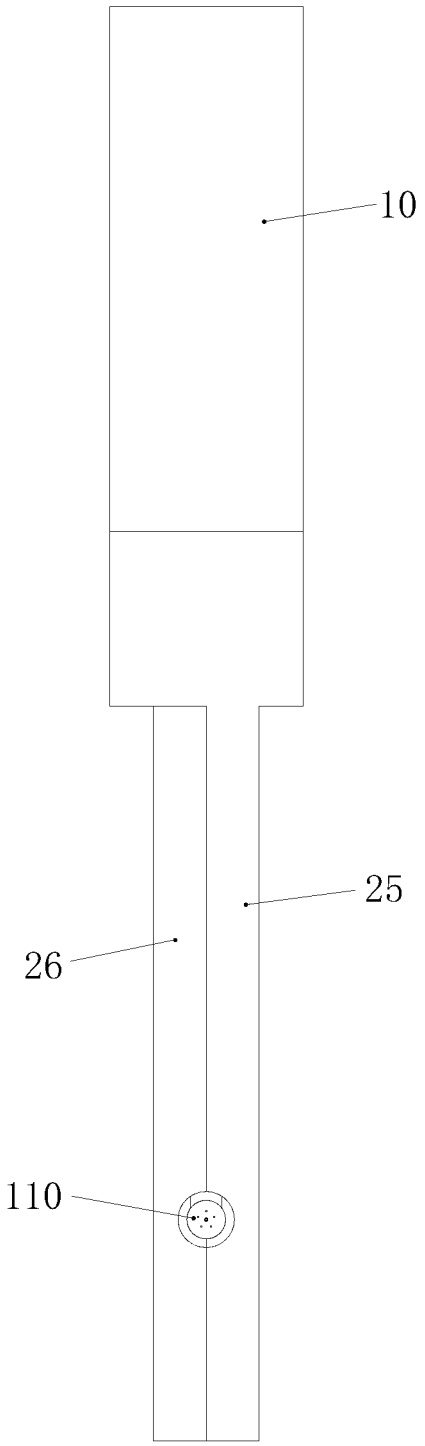
FIG. 3 is a right schematic view of an auxiliary feeding device for a flexible pipe of a radial horizontal well according to the present invention.
Figure 7:
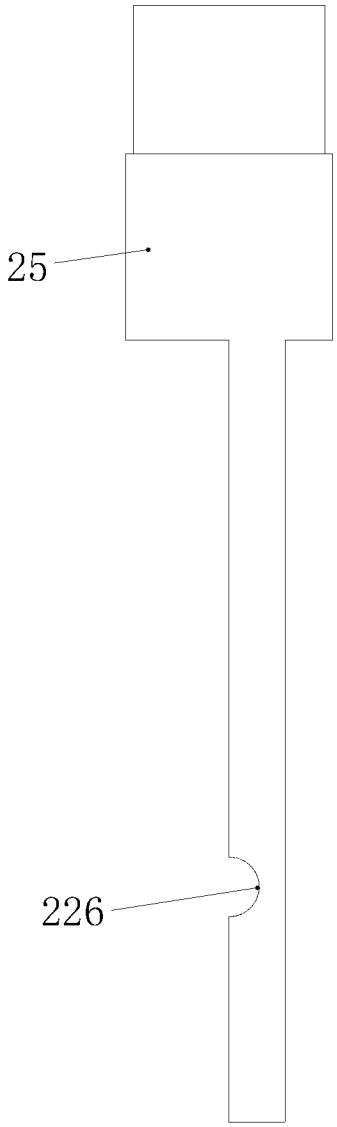
FIG. 7 is a right schematic view of a first steering body of an auxiliary feeding device for a flexible pipe of a radial horizontal well according to the present invention.

Further, as shown in FIGS. 2 and 3, the steering gear 20 comprises a first steering body 25 and a second steering body 26. As shown in FIGS. 6 and 7, the accommodating groove 21 is disposed on an upper end surface of the first steering body 25, and a lower portion of the first steering body 25 has a first machined surface which is vertically disposed; the second steering body 26 has a second machined surface that is vertically disposed and is fixedly attached to the first machined surface. A first groove is provided on the first machined surface, and a second groove is provided on the second machined surface, wherein the first groove and the second groove are aligned and snap-fitted to form the steering passage 22.

The steering gear 20 is disposed as left and right parts, i.e., the first steering body 25 and the second steering body 26, that are aligned and snap-fitted. When the steering passage 22 is machined, grooves may be formed on the first machined surface and the second machined surface (i.e., the first groove and the second groove), respectively; next, the first steering body 25 is fixedly connected to the second steering body 26 by bolts; and the machining and assembly of the steering gear 20 are more convenient and precise, under the premise of ensuring that the overall structure is simple and reliable.

As another implementable embodiment, the steering gear 20 can be designed into three parts: a barrel body, a first lower split body, and a second lower split body, wherein an upwardly opening accommodating groove 21 is provided on the barrel body 21, the first lower split body and the second lower split body are connected side by side below the barrel body, and one side of the first lower split body and one side of the second lower split body are respectively provided with a first groove and a second groove which are aligned and snap-fitted to form the steering passage 22. The bottom of the accommodating groove 21 is provided with a through hole that is in communication with the inlet of the steering passage 22.

The internal structure of the steering gear 20 is complex and other parts need to be mounted. Other combined mounting manners may also be adopted for the steering gear 20, and are not enumerated herein.

Preferably, the cross sections of the first groove and the second groove are both semicircular, and after the first steering body 25 is matched and fixed with the second steering body 26, the cross section of the steering passage 22 is circular. After the assembly of the first steering body 25 and the second steering body 26 is completed, the first steering body 25 is connected to the lower end of the oil pipe 10, the accommodating groove 21 of the first steering body 25 is in communication with the lower opening of the oil pipe 10, and the steering gear 20 is anchored after being fed into the well for a predetermined depth by the oil pipe 10.

In this embodiment, after other internal parts of the steering gear 20 are assembled, the first steering body 25 and the second steering body 26 are tightly connected to each other by the cooperation between nine bolts on the second steering body 26 and the bolt holes on the first steering body 25, thereby completing the assembly.

Further, as shown in FIG. 6, the steering passage 22 comprises a vertical line segment 222, an oblique line segment 224, and an arc segment 226 which are sequentially connected from top to bottom. The inlet is located at an upper end of the straight line segment 222, the outlet is located at a tail end of the arc segment 226, and a tangential direction of a tail end of the arc segment 226 is horizontal, so that the flexible pipe 100 is extended horizontally outward from the outlet of the steering passage 22 in the radial direction of the steering gear 20. Through a reasonable track design, the frictional resistance to the flexible pipe 100 caused by the shape of the steering passage 22 is sufficiently reduced.

The usage process of the auxiliary feeding device for the flexible pipe of the radial horizontal well according to the present invention is as follows: after each of the impeller shafts 32 is inserted into a central hole of the barrel body 34 and rotatably matched therewith, each of the impeller shafts 32 is slid into the clamping section 244 of corresponding assembly chute 24 and then fixed therein. Next, the two fixing blocks 46 of each of the flow guiding and limiting bodies 40 are slid into corresponding assembly chute 24 and then fixed therein. The first steering body 25 is fixedly connected to the second steering body 26 by bolts, the first steering body 25 is connected to the lower end of the oil pipe 10, and the entire tool string is fed into the well.

The steering gear 20 is anchored after reaching a predetermined depth downhole, and then the flexible pipe 100 is put in through the upper opening of the oil pipe 10. After the oil pipe 10 is fed to the predetermined depth, the porous jet nozzle 110 and the flexible pipe 100 enter the steering passage 22 through the holding passage. At this time, the holding passage holds the high-pressure flexible pipe 100.

Pumping is started on the ground to pump the fluid (e.g., the drilling fluid). After flowing through the annular space between the oil pipe 10 and the flexible pipe 100, the flow-through area of the drilling fluid is reduced by the two slopes 422 when flowing through the flow-through gap 41 at the flow guiding and limiting body 40, thereby being pressurized to impact and drive the impellers 30 to rotate. Under the dual effects of the mechanical feeding force for the flexible pipe 100 generated by the holding passage formed at the impeller 30 and the self-feeding force generated by the porous jet nozzle 110, the flexible pipe 100 overcomes the frictional resistance, and smoothly passes through the steering passage 22 so that rock-breaking drilling is performed stably and continuously.

The above specific embodiments further explain the objectives, technical solutions and advantageous effects of the present invention in details. It should be understood that those described are just specific embodiments of the present invention, rather than limitations to the protection scope of the present invention. It should be particularly pointed out that any modification, equivalent replacement, improvement, etc., made within the spirit and scope of the present invention should be covered by the protection scope of the present invention.

The invention claimed is:

1. An auxiliary feeding device for a flexible pipe of a radial horizontal well, comprising an oil pipe (10), a steering gear (20) connected to the oil pipe (10) at a lower opening thereof, and two impellers (30);

wherein an upper end surface of the steering gear (20) is provided with an accommodating groove (21); the steering gear (20) is internally provided with a through steering passage (22) in an axial direction thereof for allowing an external flexible pipe (100) to pass through; an inlet of the steering passage (22) is located at a bottom wall of the accommodating groove (21), and an outlet of the steering passage (22) is located at a lower portion of a sidewall of the steering gear (20);

wherein the two impellers (30) are located at a bottom of the accommodating groove (21) and symmetrically disposed on two sides of the inlet; each of the impellers (30) comprises an impeller shaft (32) fixed in the accommodating groove (21), a barrel body (34) rotatably surrounding the impeller shaft (32), and at least three blades (36) fixed outside the barrel body (34), wherein the two impeller shafts (32) are parallel to each other, and each of the blades (36) is provided at a top thereof with a notch (362); and wherein during relative and synchronous rotation of the two impellers (30), the notches (362) of the two impellers (30) are in one-to-one correspondence relation at the inlet to form a holding passage that can clamp the flexible pipe (100); a lower end of the flexible pipe (100) enters the steering passage (22) through an inner cavity of the oil pipe (10), the holding passage, and the inlet from top to bottom in sequence, and protrudes from the outlet; fluid injected through an upper opening of the oil pipe (10) drives the impellers (30) to rotate downward in an axial direction of the flexible pipe (100), and causes the flexible pipe (100) clamped in the holding passage to be fed downward.

2. The auxiliary feeding device for a flexible pipe of a radial horizontal well according to claim 1, further comprising two flow guiding and limiting bodies (40) which are symmetrically disposed on two sides of the inlet to form a flow-through gap (41) therebetween;

wherein each of the flow guiding and limiting bodies (40) is fixed in the accommodating groove (21), and disposed above corresponding impeller (30); the fluid injected through the upper opening of the oil pipe (10) passes through the flow-through gap (41), applies a force to the two blades (36) forming the holding passage, and drives the impellers (30) to rotate downward in the axial direction of the flexible pipe (100).

3. The auxiliary feeding device for a flexible pipe of a radial horizontal well according to claim 2, wherein each of the flow guiding and limiting bodies (40) at least comprises a flow guiding body (42), one side of which abuts against a sidewall of the accommodating groove (21), and an opposite side of which is provided with a slope (422); and wherein the flow-through gap (41) is located between two slopes (422), and the flow-through gap (41) has a truncated cone shape that is reduced from top to bottom.

4. The auxiliary feeding device for a flexible pipe of a radial horizontal well according to claim 3, wherein each of the flow guiding and limiting bodies (40) further comprises a limiting block (44) that is fixed to a bottom of the fluid guiding body (42);

and wherein each of the limiting blocks (44) is extended in a rotation direction of the corresponding blade (36), and a cross-sectional shape of the limiting block (44) is matched with a shape of the notch (362).

5. The auxiliary feeding device for a flexible pipe of a radial horizontal well according to claim 3, wherein each of the flow guiding and limiting bodies (40) further comprises at least one fixing block (46) that is fixed to a sidewall of the flow guiding body (42);

and wherein the accommodating groove (21) is provided on the sidewall thereof with assembly chutes (24) which are slidably matched with the fixing blocks (46) respectively, and the fixing blocks (46) can be fixed in the assembly chutes (24).

6. The auxiliary feeding device for a flexible pipe of a radial horizontal well according to claim 5, wherein each of the impeller shafts (32) is horizontally disposed, and two ends of each of the impeller shafts (32) are fixed in the assembly chutes (24), respectively.

7. The auxiliary feeding device for a flexible pipe of a radial horizontal well according to claim 6, wherein each of the assembly chutes (24) comprises a slide-in section (242) and a clamping section (244) which are sequentially disposed from top to bottom; wherein a width of the clamping section (244) is smaller than a width of the slide-in section (242); and wherein the two ends of each of the impeller shafts (32) are fixed in corresponding clamping sections (244), respectively.

8. The auxiliary feeding device for a flexible pipe of a radial horizontal well according to claim 3, wherein a distance between lower ends of the two slopes (422) is smaller than a distance between the two impeller shafts (32).

9. The auxiliary feeding device for a flexible pipe of a radial horizontal well according to claim 1, wherein the blades (36) are tabulate, extended in an axial direction of the corresponding impeller shaft (32), and evenly arranged in a circumferential direction of the corresponding impeller shaft (32).

10. The auxiliary feeding device for a flexible pipe of a radial horizontal well according to claim 1, wherein the notch (362) is semi-circular, the holding passage is circular, and an inner diameter of the holding passage is smaller than an outer diameter of the flexible pipe (100).

11. The auxiliary feeding device for a flexible pipe of a radial horizontal well according to claim 1, wherein the steering gear (20) comprises a first steering body (25) and a second steering body (26);

wherein the accommodating groove (21) is disposed on an upper end surface of the first steering body (25), and a lower portion of the first steering body (25) has a first machined surface which is vertically disposed; wherein the second steering body (26) has a second machined surface that is vertically disposed and is fixedly attached to the first machined surface; and wherein a first groove is provided on the first machined surface, and a second groove is provided on the second machined surface, the first groove and the second groove being aligned and snap-fitted to form the steering passage (22).

12. The auxiliary feeding device for a flexible pipe of a radial horizontal well according to claim 1, wherein the steering passage (22) comprises a vertical line segment (222), an oblique line segment (224), and an arc segment (226) which are sequentially connected from top to bottom;

wherein the inlet is located at an upper end of the straight line segment (222), the outlet is located at a tail end of the arc segment (226), and a tangential direction of a tail end of the arc segment (226) is horizontal.

* * * * *